US007121546B2

(12) United States Patent
Johnson et al.

(10) Patent No.: US 7,121,546 B2
(45) Date of Patent: Oct. 17, 2006

(54) SPEED MODE FOR PRINTER MEDIA TRANSPORT

(75) Inventors: Kevin Matthew Johnson, Georgetown, KY (US); Michael William Lawrence, Lexington, KY (US); Barry Baxter Stout, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 107 days.

(21) Appl. No.: 10/917,097

(22) Filed: Aug. 12, 2004

(65) Prior Publication Data

US 2006/0071390 A1 Apr. 6, 2006

(51) Int. Cl.
*B65H 5/06* (2006.01)

(52) U.S. Cl. ..... 271/273

(58) Field of Classification Search ..... 271/10.01, 271/10.04, 10.13, 10.1, 10.11, 4.01, 10.02, 271/10.03, 273
See application file for complete search history.

(56) References Cited

U.S. PATENT DOCUMENTS 5,645,273 A * 7/1997 Nakagawa et al. ..... 271/10.1
6,304,731 B1 10/2001 Able et al.
2003/0067108 A1* 4/2003 Marra et al. ..... 271/10.01
2003/0202813 A1 10/2003 Schoedinger

* cited by examiner

*Primary Examiner*—Eileen D. Lillis
*Assistant Examiner*—Jeremy R Severson
(74) *Attorney, Agent, or Firm*—Taylor & Aust, PC

(57) ABSTRACT

A speed mode for a printer (1) which has a pivotally mounted autocompensating system (19) mounted at an intermediate position in paper guide (17). That system (19) is driven by a motor (40) through a slip drive (70, 72, 74). The motor also drives paper feed system (15). When the motor turns in a direction to feed by system (15), the intermediate system is moved away from the paper guide. In basic operation, when a sheet (5) reaches a position to be fed by the intermediate system, the motor is reversed, and the intermediate system pivots against the paper for moving it further through the paper guide. In the speed mode the intermediate system is not employed and all of the feed is by the system at the tray. Since this will not feed shorter sheets, preferably the speed mode must be positively invoked, as by operator input or definitive information in the header of a print job.

8 Claims, 8 Drawing Sheets

SPEED MODE FOR PRINTER MEDIA TRANSPORT

TECHNICAL FIELD

This invention relates to imaging devices that feed variable length media over a paper path longer than the length of some of the media to be fed.

BACKGROUND OF THE INVENTION

Printing devices utilizing a media tray under the device typically feed the media out of the tray to the rear and around a "C" shaped path to enter the imaging area and exit to the front of the device. This provides a very compact machine. Because of the varying lengths of media fed through such a device, some mechanism must be provided to accommodate the discrepancy between the length of short media and the path length. This conventionally is done by using a relatively large drive roller (or rollers) which move the media toward non-driven idler rollers to maintain contact with the media while it is being fed around the path and into the imaging area.

In a separate patent application recently filed and commonly owed with this application, an improved mechanical system to feed the documents is described and claimed which employs two autocompensating systems, one intermediate in the feed path. That system is described in detail here as this invention provides modes of use of that system which increase the speed of media through the "C" path for certain media.

DISCLOSURE OF THE INVENTION

This invention employs a mechanical system having a pivoting autocompensating feed roller located at an intermediate location in the feed path. (An autocompensating system comprises one or more feed rollers on a swing arm pivoted around a gear train which drives the feed roller.) Autocompensating systems are cost-effective and may be moved toward the media for feeding and off the media by reversing the torque to the gear train. An autocompensating system may be used to pick paper from the tray, and both autocompensating systems may be driven from one motor through different drive trains.

In basic operation the intermediate autocompensating system is moved away from the feed path until media is driven past that system. Then that system is applied to move the media while the tray autocompensating system is not driven. This assures feeding of short media, such as cards or photograph-sized media.

In accordance with this invention, modes are provided for standard-sized (non-short) media. In those modes the tray system drives the media, and the intermediate system is not employed. This avoids a pause in feeding while the intermediate autocompensating system is moved into the feed path and begins feeding. In its most cost-effective form, such a mode is operative only when the job data defines the media as sufficiently long or when an operator defines the media as sufficiently long. These alternatives add a minimum of structure to the printing system, as they involve only information received by an electronic controller of an imaging device. Alternatively, of course, the length of the media or the length of the bin holding media can be measured or obtained using sensors, as is readily done in this art.

BRIEF DESCRIPTION OF THE DRAWINGS

The details of this invention will be described in connection with the accompanying drawings, in which.

DESCRIPTION OF THE PREFERRED EMBODIMENTS

Figure 1:
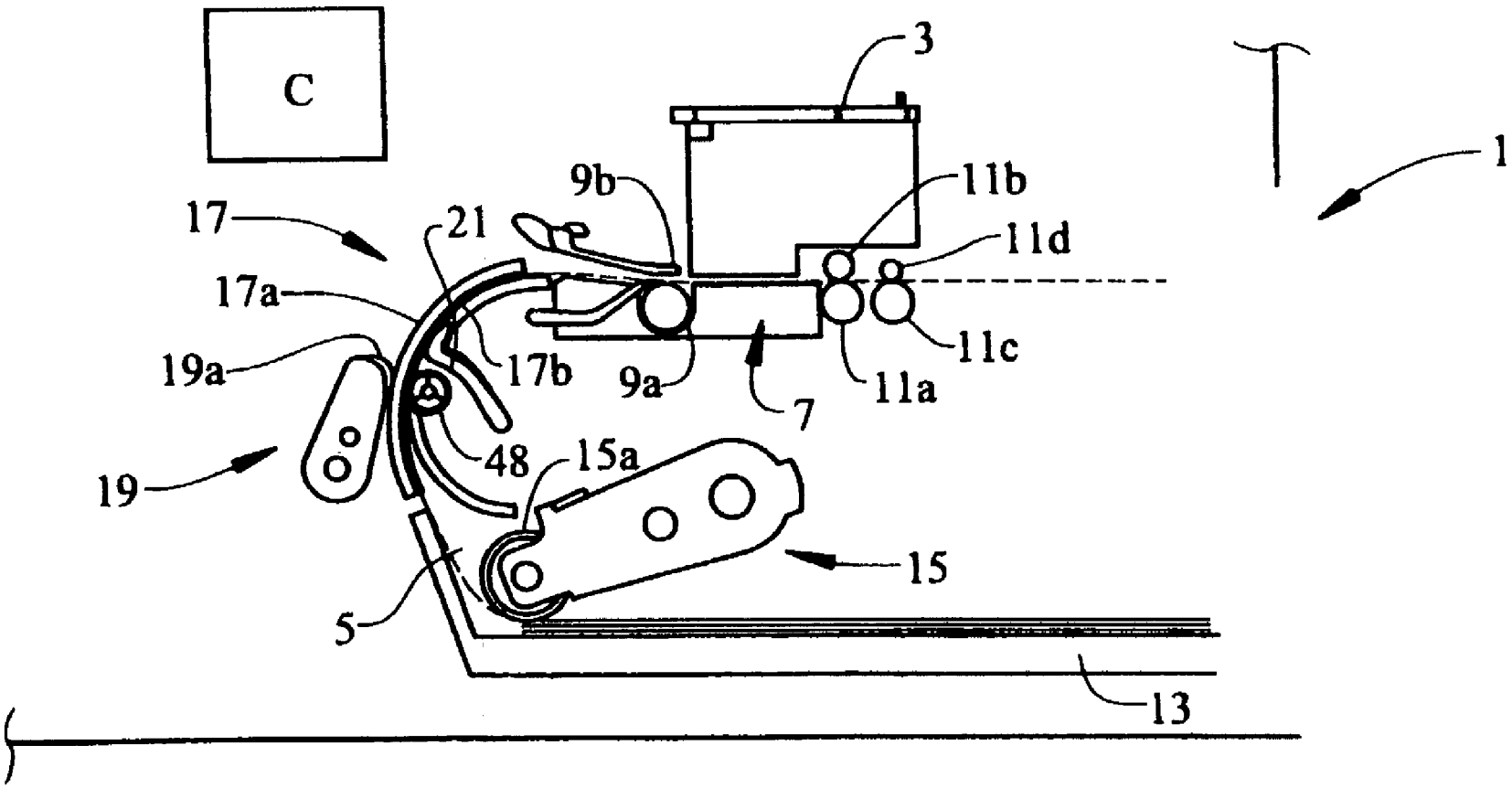
FIG. 1 is a printer and is illustrative of a long, C-shaped path between a paper tray and the imaging printhead.

FIG. 1 is illustrative of a printer 1 with specific elements pertinent to this invention. Printer 1 may be a standard inkjet printer in most respects. As such it has a bottle printhead 3 which jets dots of ink through nozzles not shown, which are located above a sheet 5 of paper or other media at a imaging station 7

Imaging station 7 is located past nip rollers 9*a*, 9*b* which grasp paper 5 in the nip of rollers 9*a*, 9*b* and move it under printhead 3. Nip rollers 9*a*, 9*b* are stopped normally several times to permit printhead 3 to partially image sheet 5 by moving across sheet 5 (in and out of the view of FIG. 1) while expelling dots in the desired pattern. In a draft mode the number of such intermittent stops may be only two, while in a quality mode that number may be five or more.

Nip rollers 9*a*, 9*b* push paper through the imaging station 7 where they enter exits rollers 11*a*, 11*b*, 11*c*, and 11*d*. Although rollers are by far the most common mechanism to transport the imaged sheet 5 out of the printer 1 to the user of the printer 1, virtually any grasping device can be used, such as a belt and pressing device or pneumatic suction device.

The printer of FIG. 1 has a paper tray 13 located on the bottom. Tray 13 constitutes a bin in which a stack of paper or other media sheets 5 are held to be imaged. Having tray 13 located on the bottom of printer 1 permits a large stack of sheets 5 to be in the printer 1. This spaces the tray 13 from the print stations 7, the distance from pick roller 15*a* of tray 13 to nip rollers 9*a*, 9*b* being longer than the length of some media sheets 5 to be printed. Pick roller 15*a* is a part of an autocompensating swing mounted system 15.

A C-shaped paper guide 17 is made up of rear guide surface 17*a* and spaced, generally parallel, front guide surface 17*b*. Both surfaces have spaced ridges (shown for surface 17*b* as 17*bb* in FIG. 2), as is common. Guide 17 directs a sheet 5 to nip rollers 9*a*, 9*b*. Intermediate in guide 17 is drive roller 19*a*, which is a part of an autocompensating swing-mounted system 19. Sensor arm 21 is moved by a sheet 5 to detect the sheet 5 at system 19.

Pick roller 15*a* at tray 13 and drive roller 19*a* combine to move sheets 5 from tray 13 to nip rollers 9*a*, 9*b*. Drive roller

19*a* is effective to move short media into rollers 9*a*, 9*b*, when pick roller 15*a* is no longer in contact with the sheet 5.

Operational control is by electronic data processing apparatus, shown as element C in FIG. 1. Such control is now entirely standard. A standard microprocessor may be employed, although an Application Specific Integrated Circuit (commonly known as an ASIC) is also employed, which is essentially a special purpose computer, the purpose being to control all actions and timing of printer 1. Electronic control is so efficient and versatile that mechanical control by cams and relays and the like is virtually unknown in imaging. However, such control is not inconsistent with this invention.

Figure 2:
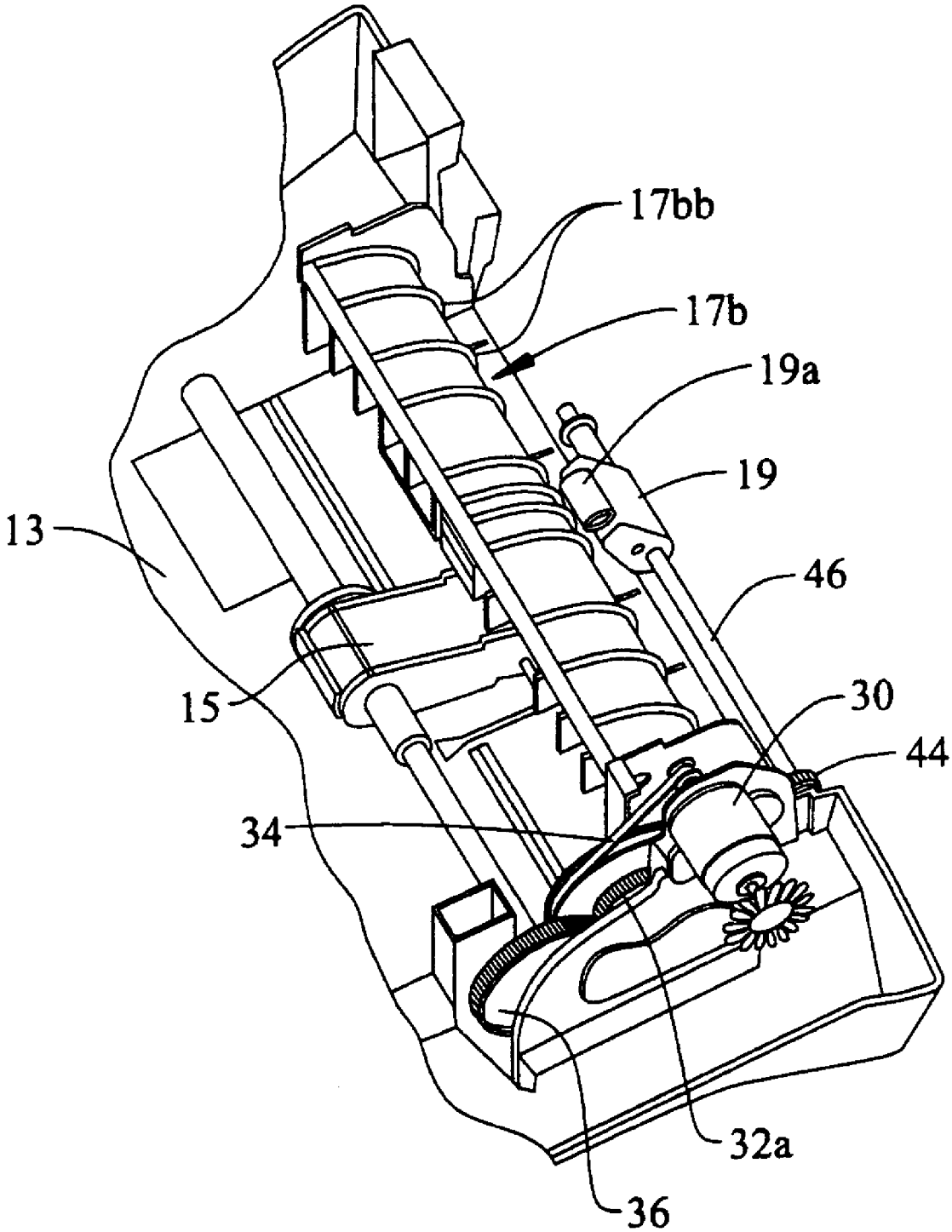
FIG. 2 is a partial, somewhat more detailed, perspective view downward on the tray and the front guide.
Figure 3:
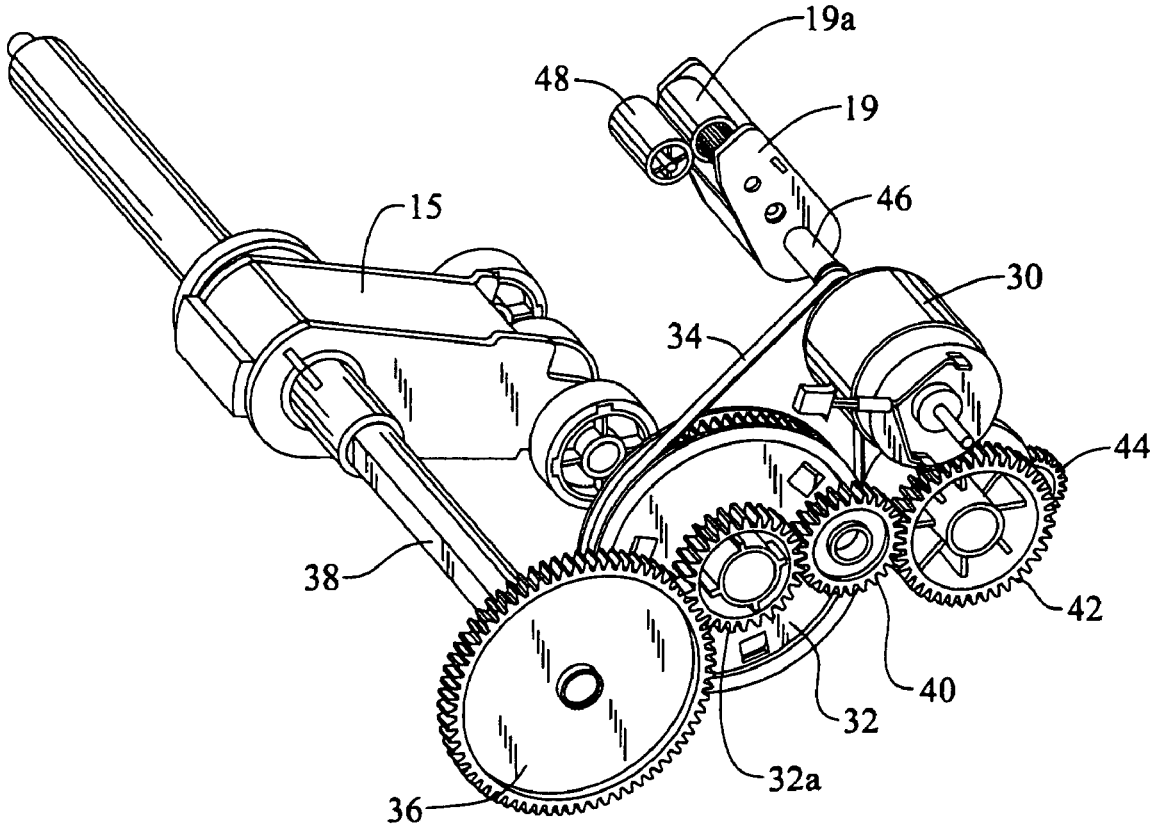
FIG. 3 is a view from the same side as the view of FIG. 2 of the motor and gear train to the autocompensating systems.
Figure 4:
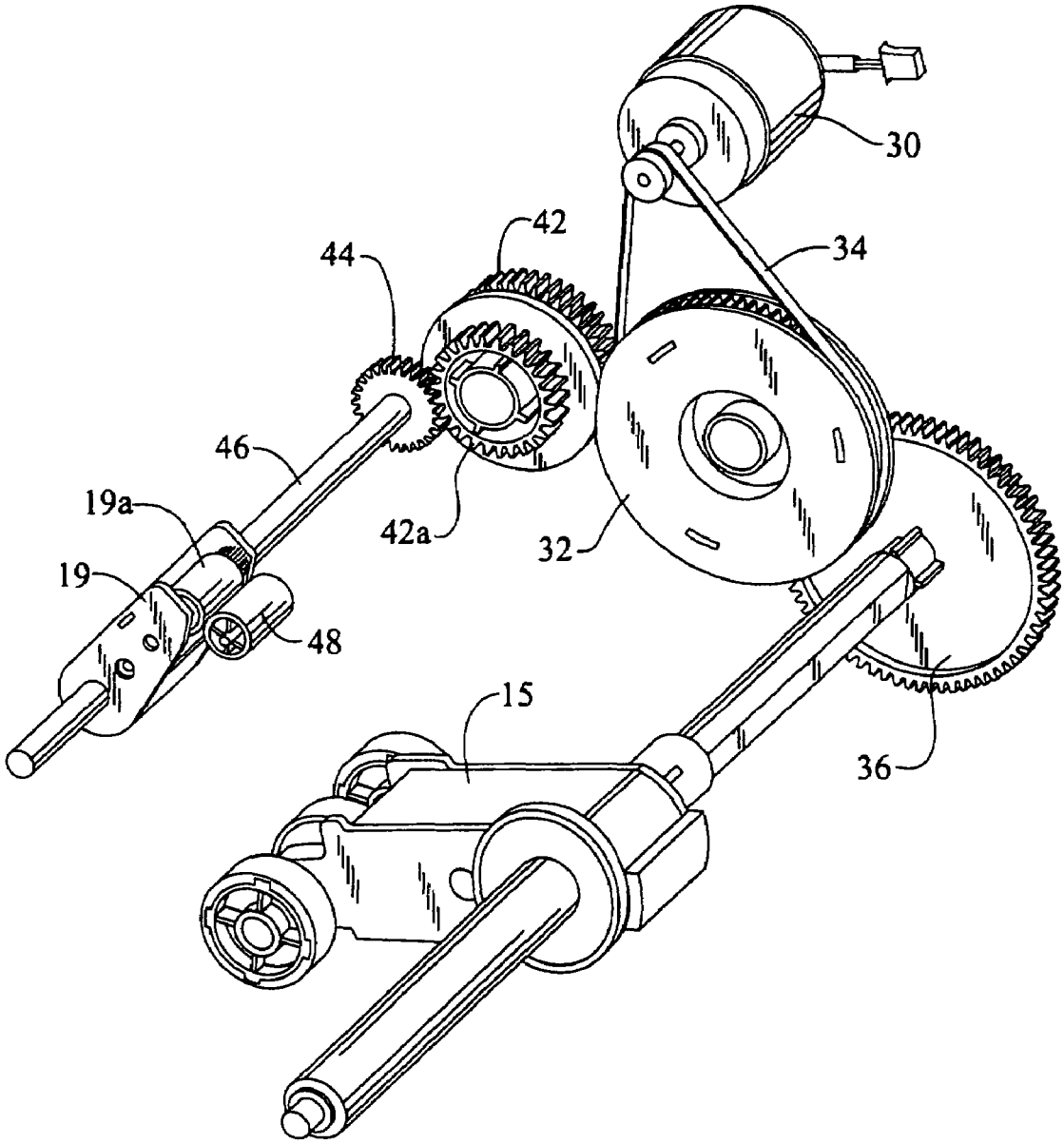
FIG. 4 is a view from the side opposite the view of FIG. 2 of motor and gear trains to the autocompensating systems.

Movement of parts in the printer is by one motor 30, shown in FIGS. 2, 3 and 4. With respect to FIG. 3 motor 30 is seen to drive a large gear 32 through a pulley 34. Gear 32 has integral with it a central, smaller gear 32*a*. The gear 32 is meshed with large gear 36, which is integral with shaft 38 to provide torque to autocompensating system 15.

Similarly, gear 32*a* meshes with idler gear 40 which meshes with a somewhat larger gear 42. Gear 42 has integral with it a central, smaller gear 42*a* (best seen in FIG. 4). Gear 42*a* is meshed with gear 44, which is integral with splined shaft 46 to provide torque to autocompensating system 19.

As is evident from the gears trains, rotation of motor 30 counterclockwise as viewed in FIG. 3 applies a downward torque (as discussed below) to autocompensating system 15 and an upward torque (as discussed below) to autocompensating system 19. Rotation of motor 30 clockwise reverses the direction of torque to both system 15 and system 19.

FIGS. 3 and 4 also illustrate a roller 48, which is mounted to roll free, which drive roller 19*a* contacts when driving should no media sheet 5 be under roller 19*a*, which avoids a high downward torque being generated. With respect to roller 15*a* in the tray 13, no comparable apparatus to roller 48 is used as the high torque can be used to signal absence of paper and therefore to terminate drive to autocompensating system 15.

Figure 5:
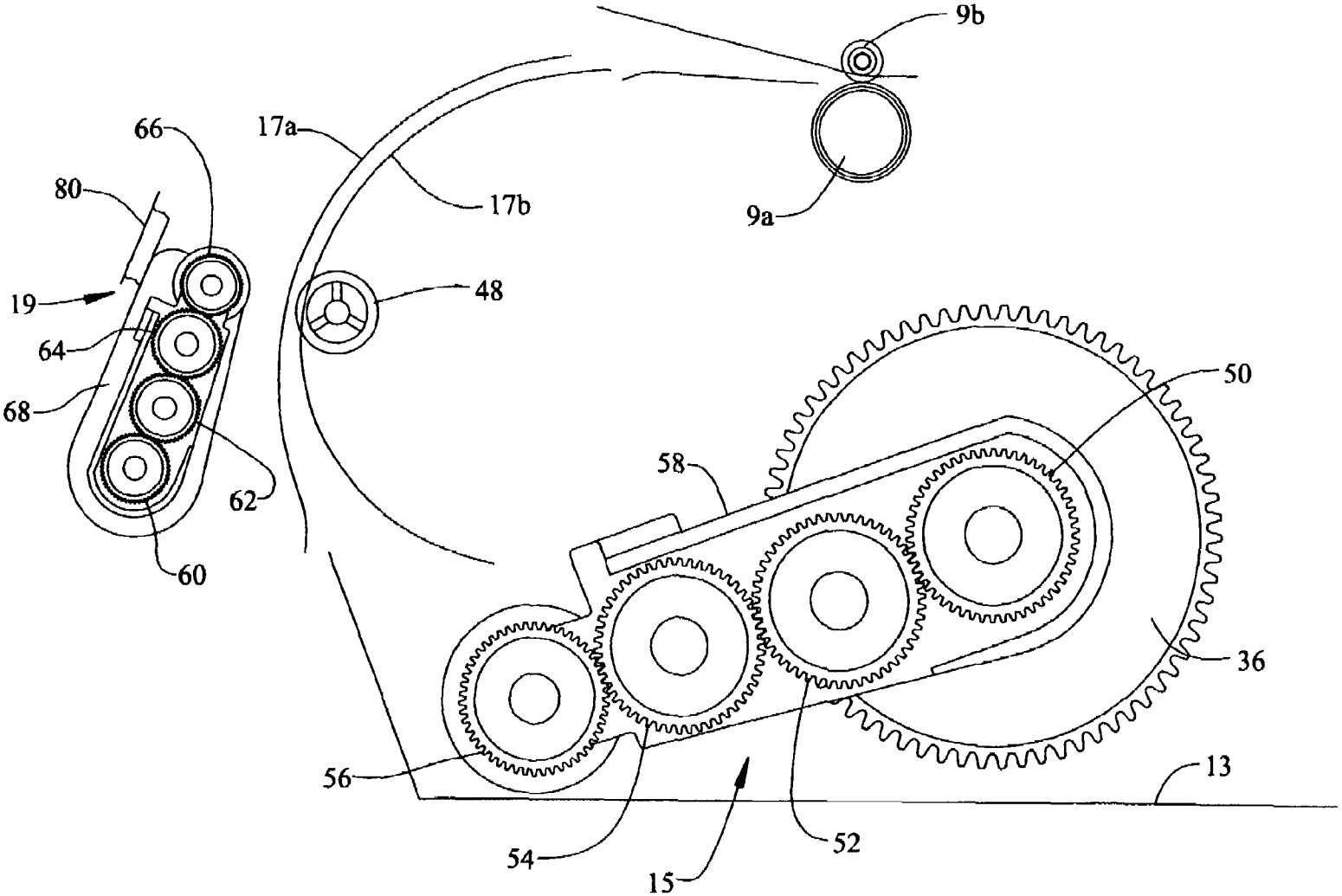
FIG. 5 illustrates the autocompensating systems in some detail and the drive path between tray and nip roller preceding the imaging station.

With reference to FIG. 5, autocompensating system 15 is seen to have four meshed gears 50, 52, 54 and 56 each meshed to the next gear in a linear train and supported within a bracket 58. Gear 56 is integral with drive roller 15*a* so that it moves both by pivoting (when gear 56 pivots) and by rotation (when gear 56 rotates). Gear 50 on the opposite end of the train of gears 50, 52, 54, and 56 is rotated by shaft 38 (FIGS. 2, 3 and 4). Similarly for autocompensating system 19 gears 60, 62, 64 and 66 are each meshed to the next gear in a linear train and supported within a bracket 68. Gear 66 is integral with drive roller 19*a* so that it moves both by pivoting (when gear 66 pivots) and by rotation (when gear 66 rotates).

Assuming counterclockwise torque to gear 50 and clockwise torque to gear 60, so long as gear 56 of system 15 or gear 66 of system 19 is not rotating, the torque pivots bracket 58 or bracket 68 respectively and the force against a sheet 5 of drive roller 15*a* and 19*a* increases toward the maximum pivoting force which can be applied by motor 30. This force is immediately relieved when gear 56 rotates in the case of system 15 and when gear 66 rotates in the case of system 19. Such rotation occurs when a sheet 5 is being moved, and it is the increase in pivot force against the sheet until it is moved which constitutes autocompensating in the systems.

Opposite or no rotation from the feeding rotation of gears 50 and 60 relieve pivoting torque because the direction of pivot is away from the feeding position and therefore the gears 56 and 66 respectively are free to rotate. To prevent such rotation with respect to system 15, gear 50 is driven through a one-way clutch, (not shown), which may be a conventional ball-and-unsymmetrical-notch clutch or other clutch.

Figure 6:
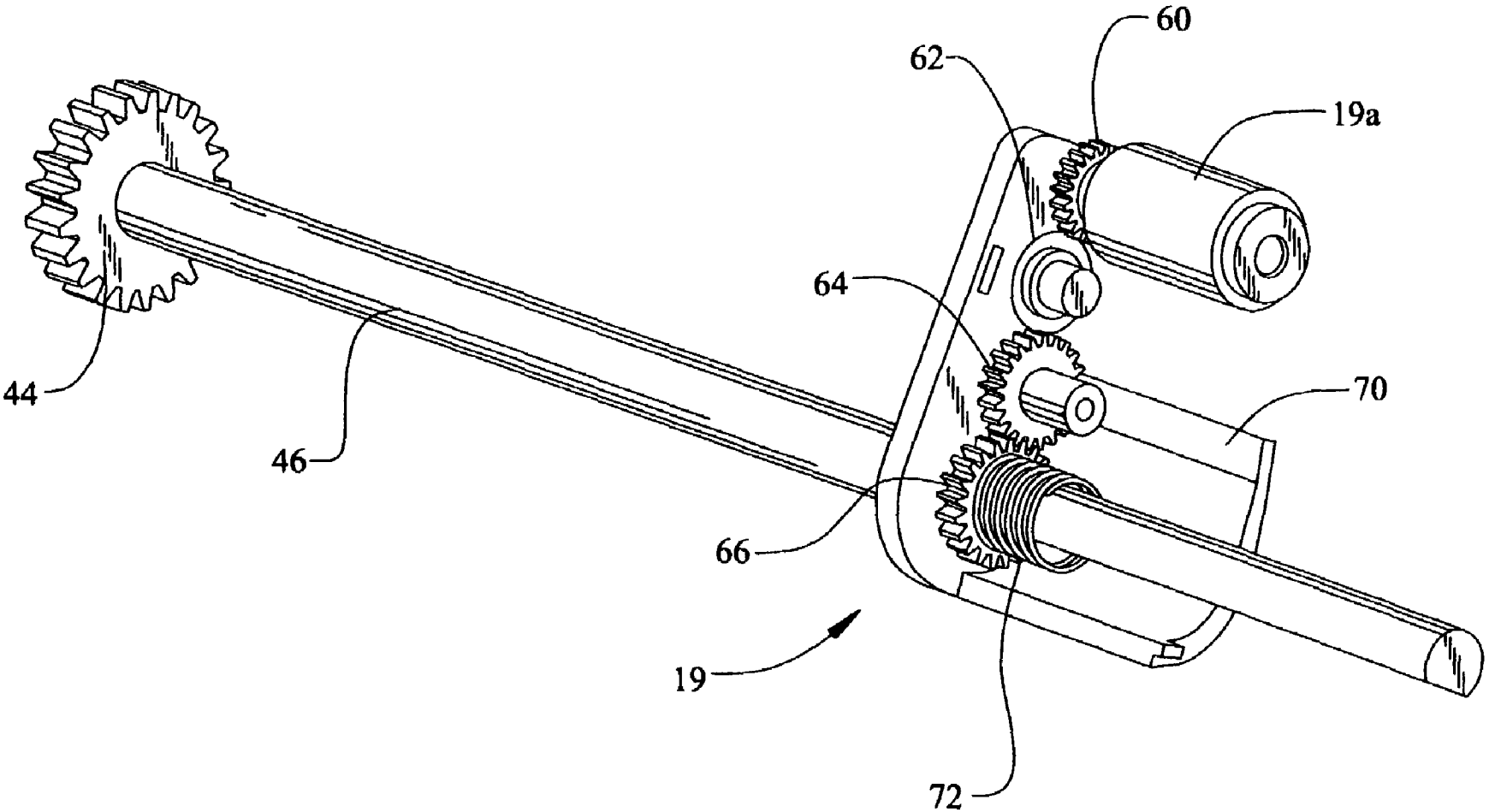
FIG. 6 is a perspective view of selected elements to explain the slip drive.

FIG. 5 shows autocompensation system positively moved away from the guide 17. This occurs when gear 60 is driven in the direction opposite to sheet feed. To achieve that, an added mechanism is applied to the autocompensation system 15, which is illustrated in FIG. 6 and FIG. 7.

This mechanism is a slip drive. As shown in FIG. 6, within the housing 70 of autocompensating system 19 is a coil spring 72 mounted on drive shaft 46 and having one side in contact with the face of gear 66.

Figure 7:
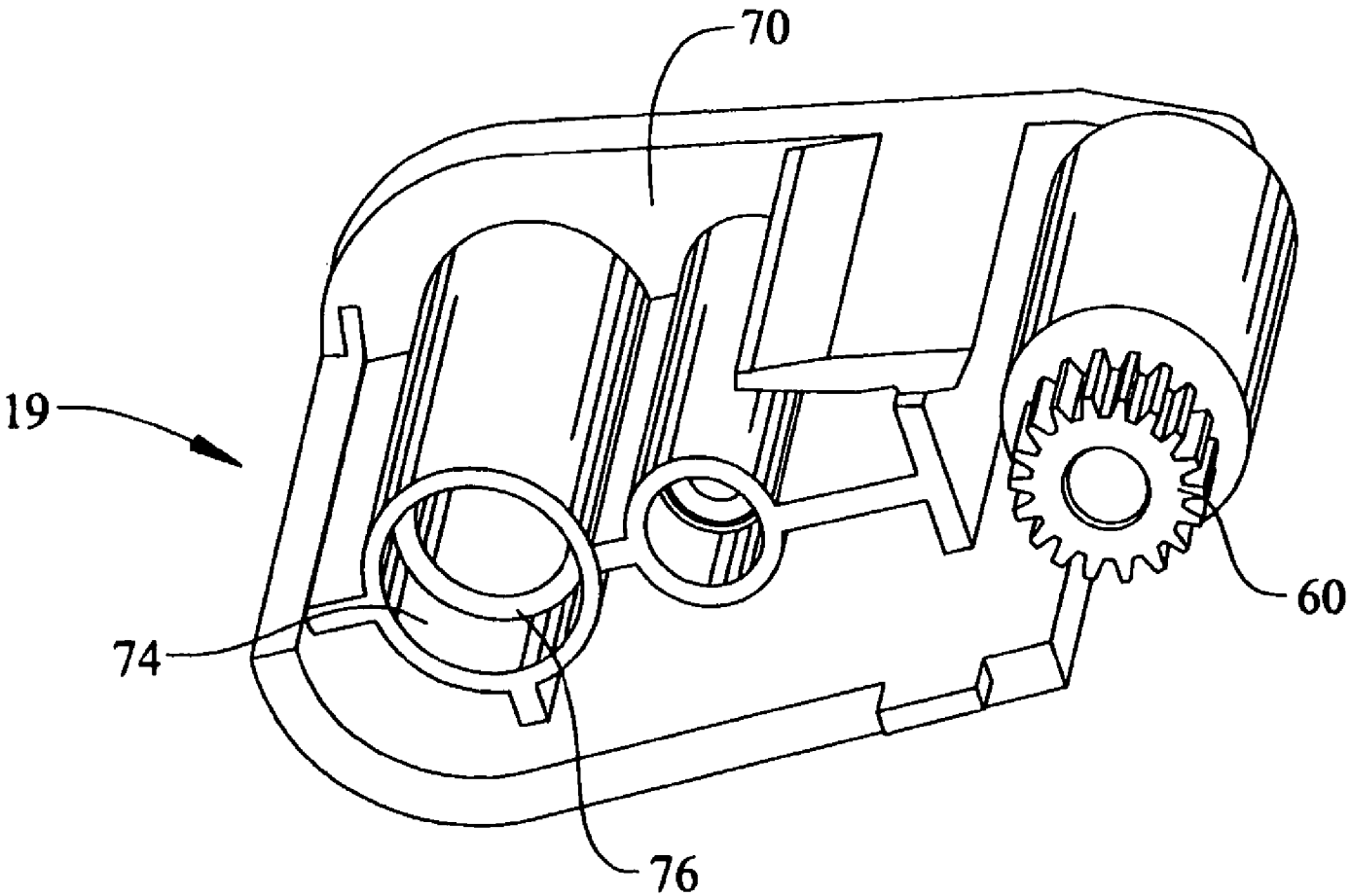
FIG. 7 is a perspective view of selected elements from the side opposite to that of FIG. 6 to explain the slip drive.

As shown in FIG. 7, housing 70 has a cylindrical well 74 with bottom face 76 which receives the side of spring 72 (FIG. 6) opposite to that which faces gear 66. The dimensions of well 74 are such that spring 72 is compressed.

With spring 72 compressed, the turning of gear 66 turns spring 72 and the turning of spring 72 tends to rotate the entire housing 70, since well 74 is integral with housing 70. However, when further rotation is blocked, spring 72 simply slips.

When gear 66 is rotated in the reverse feeding direction, system 19 is moved away from the drive path of guide 17 as shown in FIG. 5, where it is stopped by being blocked by a fixed member 80, which may be integral with the structure forming guide 17.

When gear 66 is rotated in the feeding direction, spring 72 adds somewhat to the downward force while slipping.

In basic operation, under control of controller C, motor 30 is driven to feed a sheet 5 from tray 13 by rotating autocompensating system 15 downward. Autocompensating system 19 is necessarily driven by the slip drive to move away from the paper feed direction. Accordingly, when a sheet 5 is being moved by system 15, system 19 is moved completely out of guide path 17, as shown in FIG. 4.

In operation when the length of sheet 5 is not considered, the sheet 5 moves to encounter sensor arm 21 (FIG. 1). Then the controller C reverses motor 30. The direction of rotation of motor 30 is reversed, causing autocompensating system 19 to pivot to contact sheet 5, while autocompensating system 15 has no torque since the one-way clutch (not shown), prevents any drive to autocompensating system 15.

System 19 moves sheets 5 until they reach nip roller 9*a*, 9*b* and, preferably, become somewhat buckled. The buckling serves to align sheets 5. The remaining imaging operation may be entirely standard.

In accordance with this invention, a mode is provided in which longer sheets are fed to the nip rollers 9*a*, 9*b* by autocompensating system 15 alone. Autocompensating system 19 necessarily remains held out of the feed position because of the direction of rotation of motor 30. In a representative system, assuming acceleration and deceleration of rollers 15*a* and 19*a* of about 50 inches per second (ips) and maximum speed of 25 ips, feed time of media to nip rollers 9*a*, 9*b* is calculated to be reduced from about 370 milliseconds to about 320 milliseconds.

Figure 8:
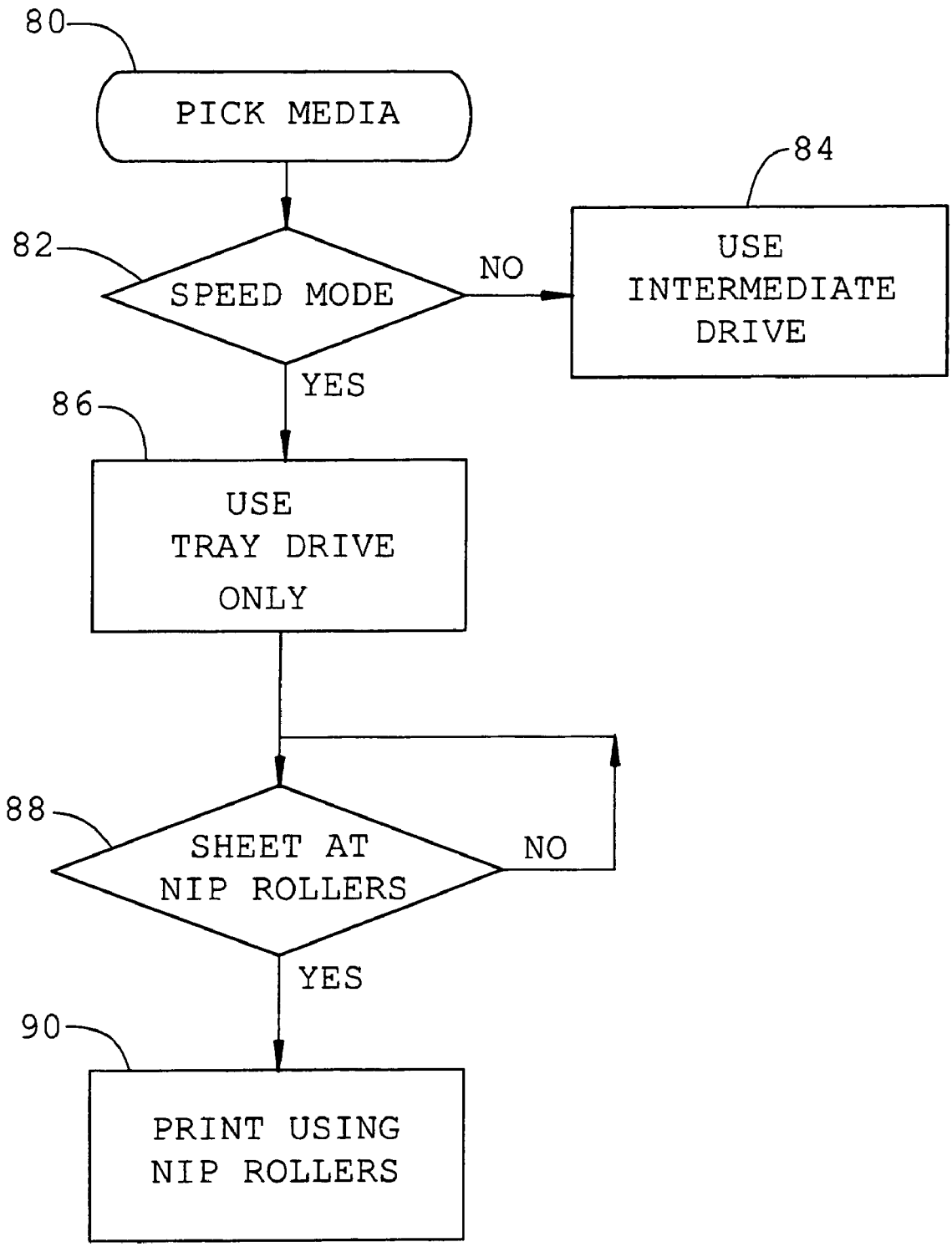
FIG. 8 illustrates the sequence of operations in accordance with this invention.

The sequence of such a mode is illustrated in FIG. 8. Action 80, occurrence of a pick signal, invokes decision 82, which determines if the speed mode of this invention is activated. If no, action 84 is invoked to feed sheets using the intermediate autocompensating system 19. If decision 82 is yes, action 86, feed sheets only by autocompensating system 15 is conducted and decision 88 is invoked.

Decision 88 determines if a sheet 5 has reached the nip rollers 9*a*, 9*b*. If no, decision 88 is invoked again at short intervals. If yes, decision 88 invokes action 90, which continues normal printing by the nip rollers 9*a*, 9*b*.

As discussed, with a sheet 5 at nip rollers 9*a*, 9*b*, the nip rollers 9*a*, 9*b* first turn in reverse feed direction align to register sheet 5 and then turn to transport sheet 5 into the imaging station 7 for normal printing. Nip rollers 9*a*, 9*b* are proximate to imaging station 7 to permit all sheets to be fed into imaging station 7.

Determination of whether a sheet 5 has reached nip rollers 9*a*, 9*b* may be by any standard method such as by a sheet-presence sensor such as sensor arm 21 or by controller C tracking sheet movement.

If this speed move is the default mode, then misfeeds must be avoided by positively identifying media which is short. Accordingly, the feed mode preferably is positively invoked and the default is to use the intermediate roller is feeding all sheets. Since all of the operation discussed is necessarily under the control of the electronic control C, positive invoking of the speed mode may be by input by a human operator through a control panel (not shown) of the printer 1 or by controller C recognizing a media description in the data of a print job and invoking the speed mode just for that print job (print jobs typically have lead or "header" information and such information may definitively define media length). The print job may call for feeding from a tray reserved or unique to short media, thereby positively identifying the size of the media. The length of sheet may, of course, be measured by sensors and the size of a bin carrying sheets may be measured by sensors, which is well within the state of the art, but adds some complexity and costs to the imaging device. Where the length of the first sheet of a job is known, normally it can be assumed that all sheet of that job are of the known length.

A disadvantage of the speed mode is that the media is more positively guided when the intermediate feed is employed. This positive guidance can be used to position the media against one or more sensors or the like.

An additional advantage of a speed mode is quieter operation since reversing motor direction causes some clash of gears.

It will be recognized that this invention can take alternative forms, so long as an autocompensating system is used at least at the intermediate drive location.

What is claimed is:

1. An imaging device comprising:

an imaging station, a sheet media tray spaced from said imaging station, a media guide path between said imaging station and said media tray, a media drive member to move sheet media from said sheet media tray into said paper guide path, a pivotally mounted first autocompensating system located in said paper guide path for driving media, a motor to provide torque to said autocompensating system, and an electronic control for said imaging device having a first mode in which said first autocompensating system is pivoted away from said media guide path while said media drive member moves sheets from said tray to be proximate to said imaging station and having a second mode in which said first autocompensating system is pivoted into said media guide path and said media drive member moves sheets from said tray to said first autocompensating system, wherein a selection of one of said first mode and said second mode is made based on a length of at least one sheet.

2. The imaging device as in claim 1 in which said motor drives said first autocompensating system for sheet feed and drives said media drive member for sheet feed, said first autocompensating system comprises a slip drive from said motor operative to move said first autocompensating system away from said media guide path when said motor is rotating to provide torque to said media drive member opposite to torque for media feed in said guide by said first autocompensating system, and said electronic control operates said motor only to provide torque for media feed by said media drive member when in said first mode.

3. An imaging device comprising:

an imaging station, a sheet media tray spaced from said imaging station, a media guide path between said imaging station and said media tray, a pivotally mounted first autocompensating system located in said paper guide path for driving media, a pivotally mounted second autocompensating system to feed media from said sheet media tray through said media guide path at least to a location at which said first autocompensating system can feed said media, a motor to provide torque to said first autocompensating system and said second autocompensating system, and an electronic control for said imaging device having a first mode in which said first autocompensating system is pivoted away from said media guide path while said second autocompensating system moves sheets from said from said tray to be proximate to said imaging station and having a second mode in which said first autocompensating system is pivoted into said media guide path and said second autocompensating system moves sheets from said tray to said first autocompensating system, wherein a selection of one of said first mode and said second mode is made based on a length of at least one sheet.

4. The imaging device as in claim 3 in which said first autocompensating system comprises a slip drive from said motor operative to move said first autocompensating system away from said media guide path when said motor is rotating to provide torque to said first autocompensating system opposite to torque for media feed in said guide by said first autocompensating system, and in which said electronic control operates said motor only to provide torque for media feed by said second autocompensating system when in said first mode.

5. An imaging device comprising:

an imaging station, sheet transport rollers proximate to said imaging station to move sheets into said imaging station, a sheet media tray spaced from said imaging station, a media guide path between said imaging station and said media tray, a media drive member to move sheet media from said sheet media tray into said paper guide path, a pivotally mounted first autocompensating system located in said paper guide path for driving media, a motor to provide torque to said autocompensating system, and an electronic control for said imaging device having a first mode in which said first autocompensating system is pivoted away from said media guide path while said media drive member moves sheets from said tray to be proximate to said imaging station and having a second mode in which said first autocompensating system is pivoted into said media guide path and said media drive member moves sheets from said tray to said first autocompensating system, wherein a selection of one of said first mode and said second mode is made based on a length of at least one sheet.

6. The imaging device as in claim 5 in which said motor drives said first autocompensating system for sheet feed and drives said media drive member for sheet feed, said first autocompensating system comprises a slip drive from said motor operative to move said first autocompensating system away from said media guide path when said motor is rotating to provide torque to said media drive member opposite to torque for media feed in said guide by said first autocompensating system, and said electronic control operates said motor only to provide torque for media feed by said media drive member when in said first mode.

7. The imaging device as in claim 6 also comprising a second pivotally mounted autocompensating system to feed media from said sheet media tray through said media guide path at least to a location at which said first autocompensating system can feed said media, and in which said electronic control operates said motor only to provide torque for media feed by said second pivotally mounted autocompensating system when in said first mode.

8. An imaging device comprising:

an imaging station, a sheet media tray spaced from said imaging station, a media guide path between said imaging station and said media tray, a first media drive member to move sheet media from said sheet media tray into said paper guide path, a second media drive member located in said paper guide path for driving media, and an electronic control for said imaging device having a first mode in which said second media drive member is pivoted away from said media guide path while said first media drive member moves sheets from said tray to be proximate to said imaging station and having a second mode in which said second media drive member is pivoted into said media guide path and said first media drive member moves sheets from said tray to said second media drive member, said electronic control operating in said first mode when length of sheet media to be imaged is positively identified by said electronic control as sufficiently long for operation in said first mode and said electronic control operating is in said second mode when length of sheet media to be imaged is not positively identified as sufficiently long by said electronic control.

* * * * *